US008613257B2

(12) United States Patent
Wockatz

(10) Patent No.: US 8,613,257 B2
(45) Date of Patent: Dec. 24, 2013

(54) STITCHED MULTIAXIAL NON-CRIMP FABRICS

(75) Inventor: Ronny Wockatz, Dusseldorf (DE)

(73) Assignee: Toho Tenax Europe GmbH, Wuppertal (DE)

( * ) Notice: Subject to any disclaimer, the term of this patent is extended or adjusted under 35 U.S.C. 154(b) by 0 days.

(21) Appl. No.: 13/581,782

(22) PCT Filed: Mar. 11, 2011

(86) PCT No.: PCT/EP2011/053657

§ 371 (c)(1),
(2), (4) Date: Aug. 29, 2012

(87) PCT Pub. No.: WO2011/113751

PCT Pub. Date: Sep. 22, 2011

(65) Prior Publication Data

US 2012/0318182 A1 Dec. 20, 2012

(30) Foreign Application Priority Data

Mar. 18, 2010 (EP) ..... 10002869

(51) Int. Cl.
*B32B 7/04* (2006.01)

(52) U.S. Cl.
USPC ..... 112/440

(58) Field of Classification Search
USPC ..... 112/400, 401, 402, 412, 415, 420, 421, 112/440; 428/102, 365, 212; 442/334–337
See application file for complete search history.

(56) References Cited

U.S. PATENT DOCUMENTS

| | | | | |
|---|---|---|---|---|
| 4,857,379 | A | 8/1989 | Plontges et al. | |
| 6,890,476 | B2 * | 5/2005 | Wagener et al. | 264/478 |
| 6,986,929 | B2 * | 1/2006 | Tsotsis | 112/439 |
| 7,503,273 | B2 * | 3/2009 | Beneventi et al. | 112/475.04 |
| 2006/0252334 | A1 | 11/2006 | LoFaro et al. | |
| 2007/0202762 | A1 | 8/2007 | Hirawaki et al. | |

(Continued)

FOREIGN PATENT DOCUMENTS

| | | |
|---|---|---|
| DE | 35 35 272 A1 | 4/1987 |
| DE | 93 06 255 U1 | 6/1993 |

(Continued)

OTHER PUBLICATIONS

Jun. 17, 2011 International Search Report issued in International Application No. PCT/EP2011/053657 (with translation).

*Primary Examiner* — Danny Worrell
(74) *Attorney, Agent, or Firm* — Oliff & Berridge, PLC

(57) ABSTRACT

A multiaxial non-crimp fabric comprising at least two superimposed layers of multifilament reinforcing yarns arranged within the layers parallel to each other and abutting parallel together. The reinforcing yarns within one layer as well as adjacent layers are connected and secured against each other by sewing threads forming stitches proceeding parallel to and separated from each other at a stitch width w, the sewing threads form stitches with a stitch length s, and the zero-degree direction of the non-crimp fabric is defined by the sewing threads. The reinforcing yarns of the layers are symmetrically arranged in respect to the zero-degree direction of the non-crimp fabric and form an angle α to the zero-degree direction, the angle not being equal to 90° or 0°, and the sewing threads have a linear density from 10 to 35 dtex.

14 Claims, 2 Drawing Sheets

(56) References Cited

U.S. PATENT DOCUMENTS

| | | | | |
|---|---|---|---|---|
| 2008/0289743 | A1 | 11/2008 | Tsotsis | |
| 2012/0100354 | A1* | 4/2012 | Beraud et al. | 112/402 |
| 2012/0318182 | A1* | 12/2012 | Wockatz | 112/440 |

FOREIGN PATENT DOCUMENTS

| | | | |
|---|---|---|---|
| DE | 198 02 135 | A1 | 1/1999 |
| DE | 199 13 647 | A1 | 9/2000 |
| DE | 199 25 588 | A1 | 12/2000 |
| DE | 102 52 671 | C1 | 12/2003 |
| DE | 20 2004 007 601 | U1 | 11/2004 |
| DE | 10 2005 033 107 | B3 | 1/2007 |
| EP | 0 193 479 | A1 | 9/1986 |
| EP | 0 323 571 | A2 | 7/1989 |
| EP | 0 361 796 | A2 | 4/1990 |
| EP | 0 672 776 | A1 | 9/1995 |
| EP | 1 057 605 | A1 | 12/2000 |
| EP | 1 705 269 | A1 | 9/2006 |
| WO | WO 98/10128 | | 3/1998 |
| WO | WO 02/057527 | A1 | 7/2002 |
| WO | WO 2005/028724 | A2 | 3/2005 |
| WO | WO 2006/055785 | A1 | 5/2006 |

* cited by examiner

| Laminate from: | Linear density of the sewing yarn [dtex] | Micrographs perpendicular to the 0° orientation |
|---|---|---|
| Example 3 | 23 |  |
| Example 4 | 35 |  |
| Comp. example 3 | 48 |  |

STITCHED MULTIAXIAL NON-CRIMP FABRICS

TECHNICAL FIELD

The invention relates to a multiaxial non-crimp fabric made from at least two superimposed layers of multifilament reinforcing yarns which are arranged within the layers parallel to each other and abutting parallel together, wherein the reinforcing yarns within one layer as well as adjacent layers are connected to each other and secured against each other by sewing threads proceeding parallel to each other and separated from each other at a stitch width w, wherein the sewing threads form stitches with a stitch length s, and wherein the zero-degree direction of the non-crimp fabric is defined by the sewing threads, and wherein the reinforcing yarns of the layers are symmetrically arranged in respect of the zero-degree direction of the composite and, with respect to the direction of their extension, form an angle $\alpha$ to the zero-degree direction.

BACKGROUND

Multiaxial non-crimp fabrics have been known on the market for a long time. Multiaxial non-crimp fabrics are understood to be structures made from a plurality of superimposed fiber layers, wherein the fiber layers comprise sheets of reinforcing yarns arranged parallel to each other. The superimposed fiber layers can be connected and secured to each other via a plurality of sewing or knitting threads arranged parallel to each other and running parallel to each other and forming stitches, such that the multiaxial non-crimp fabric is stabilized in this way. The sewing or knitting threads thereby form the zero-degree direction of the multiaxial non-crimp fabric.

The fiber layers are superimposed such that the reinforcing fibers of the layers are oriented parallel to each other or alternately crosswise. The angles are virtually infinitely adjustable. Usually, however, for multiaxial non-crimp fabrics angles of 0°, 90°, plus or minus 25°, plus or minus 30°, plus or minus 45°, or plus or minus 60° are set and the structure is selected such that a symmetrical structure with respect to the zero-degree direction results. Multiaxial non-crimp fabrics of this type can be produced e.g. by means of standard warp knitting looms or stitch bonding machines.

Fiber composite components produced using multiaxial non-crimp fabrics are suited in a superb way to directly counteract the forces introduced from the directions of stress of the component and thus ensure high tenacities. The adaptation in the multiaxial non-crimp fabrics, with respect to the fiber densities and fiber angles, to the load directions present in the component enables low specific weights.

Multiaxial non-crimp fabrics can be used due to their structure especially for the manufacturing of complex structures. The multiaxial non-crimp fabrics are thereby laid without matrix material in a mold and e.g. for shaping, they are adapted to the contours using increased temperatures. After cooling, a stable, so-called preform is obtained, into which the matrix material required for producing the composite component can subsequently be introduced via infusion or injection, or also by the application of vacuum. Known methods in this case are the so-called liquid molding (LM) method, or methods related thereto such as resin transfer molding (RTM), vacuum assisted resin transfer molding (VARTM), resin film infusion (RH), liquid resin infusion (LRI), or resin infusion flexible tooling (RIFT).

It is important on the one hand for the preform that the fibers within the layers as well as the individual fiber layers are secured against each other to a sufficient extent. On the other hand, with respect of the required three-dimensional shaping, a good drapability of the multiaxial non-crimp fabrics is required. Finally, it is also important that the multiaxial non-crimp fabric shaped into the preform can be easily penetrated by the matrix resin which is introduced via the above listed methods.

Multiaxial non-crimp fabrics and the manufacture thereof are described for example in DE 102 52 671 C1, DE 199 13 647 B4, DE 20 2004 007 601 U1, EP 0 361 796 A1, or U.S. Pat. No. 6,890,476 B3. According to DE 10 2005 033 107 B3, initially individual mats made from unidirectionally arranged fibers or fiber bundles are produced, in which said fibers or fiber bundles are caught in stitches by binding threads and all binding threads envelop and secure only one fiber or only one fiber bundle. In a second step, a plurality of layers of mats produced in this way are superimposed at different angles to each other and connected to each other.

EP 1 352 118 A1 discloses multiaxial non-crimp fabrics, for which the layers of the reinforcing fibers are held together by means of fusible sewing yarns. The use of fusible yarns allows, according to one of the embodiments of EP 1 352 118 A1, a shift of the layers against one another during the shaping of the multiaxial non-crimp fabrics above the melting temperature of the sewing threads and a stabilization of the form during subsequent cooling below the melting temperature, such that the sewing stitches function as an in situ binding means. The tension in the sewing yarns leads, according to the statements of EP 1 352 118 A1, initially to the formation of channel zones in the composite, resulting in a better infiltration of matrix resin. Heating the composite structure above the melting temperature of the sewing yarns results then in a reduction of tension for the sewing yarns and as a result thereof in a reduction of the waviness of the reinforcing fibers. The proportion of sewing threads in the non-crimp fabric should, according to EP 1 352 118 A1, preferably lie in the range of 0.5-10 wt. %, Often, sewing threads made from thermoplastic polymers such as polyamide or polyester are used, as is disclosed in EP 1 057 605 B1 for example. According to information from U.S. Pat. No. 6,890,476 B1, the threads used there have a linear density of approximately 70 dtex. WO 98/10128 discloses multiaxial non-crimp fabrics made from several superimposed layers, deposited at an angle, of reinforcing fibers, said layers being sewn or knitted to each other via sewing threads. WO 98/10128 discloses multiaxial non-crimp fabrics in which the stitch chains of the sewing threads have a gauge of 5 rows per 25.4 mm width (=1 inch) for example and a stitch width generally in the range from approximately 3.2 to approximately 6.4 mm (⅛-¼ inch). The sewing threads used therein have a linear density of at least approximately 80 dtex. In U.S. Pat. No. 4,857,379 B1 as well, yarns made for example from polyester were used for connecting the reinforcing yarns by means of e.g. knitting or weaving processes, wherein the yarns used there have a linear density of 50 to 3300 dtex.

DE 198 02 135 relates to multiaxial non-crimp fabrics for e.g. ballistic applications, for which superimposed layers of warp and weft threads arranged parallel to each other respectively are connected to each other by binding threads. For the multiaxial non-crimp fabrics shown in DE 198 02 135, the threads parallel to each other have a distance from each other, and the loops formed by the binding threads wind around the warp or weft threads respectively. For the binding threads used, linear densities in the range between 140 and 930 dtex are indicated. For the multiaxial non-crimp fabrics disclosed in WO 2005/028724 as well, several layers of reinforcing yarns with high linear density and arranged unidirectionally or parallel to each other are connected by binding threads that interweave between said reinforcing yarns and loop around the individual reinforcing yarns. The reinforcing yarns are separated from each other within the layers. As binding threads, yarns, for example, made from polyvinyl alcohol with a linear density of 75 denier or elastomer yarns based on polyurethane with a linear density of 1120 denier are used.

Also, randomly-laid fiber mats or non-wovens, or staple fiber fabrics or mats, are to some extent laid between the layers made from reinforcing fibers in order to improve e.g. the impregnatability of the fabrics or to improve e.g. the impact strength. Multiaxial non-crimp fabrics having such mat-like intermediate layers are disclosed for example in DE 35 35 272 C2, EP 0 323 571 A1, or US 2008/0289743 A1.

The results show that today's multiaxial non-crimp fabrics can absolutely have a good drapability and that their impregnatability with matrix resin can be satisfactory. A good level of characteristic values can be achieved for components that are produced using multiaxial non-crimp fabrics, with respect to flexural strength or tensile strength. However, these components often show an unsatisfactory level of characteristic values with regard to compression stressees and impact stresses.

The disadvantages of the unsatisfactory mechanical tenacities under compression loading and impact loading have been sufficiently serious thus far that, in spite of the above-mentioned better suitability of the materials especially for complex components, the somewhat longer established, so-called prepreg technology is employed, and thus a greater expenditure of time and higher production expenditures are accepted.

SUMMARY

Therefore, there is a need for multiaxial non-crimp fabrics that lead to improved characteristics in components or materials, in particular under compression and impact loading.

It is therefore the object of the present invention to provide a multiaxial non-crimp fabric by means of which fiber composite components having improved characteristics under compression or impact loading can be produced.

BRIEF DESCRIPTION OF THE DRAWINGS

Exemplary embodiments are described in detail below with reference to the accompanying drawings in which.

DETAILED DESCRIPTION

Figure 1:
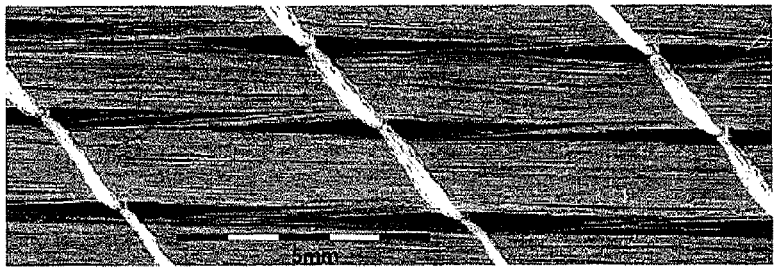
FIG. 1 is a photo of a segment of a stitched multiaxial non-crimp fabric viewed from above in a magnified presentation.

The object is achieved by a multiaxial non-crimp fabric made from at least two superimposed layers of multifilament reinforcing yarns which are arranged within the layers parallel to each other and abutting parallel together, wherein the reinforcing yarns within one layer as well as adjacent layers are connected to each other and secured against each other by sewing threads forming stitches proceeding parallel to each other and separated from each other at a stitch width w, wherein the sewing threads form stitches with a stitch length s, and the zero-degree direction of the non-crimp fabric is defined by the sewing threads, wherein the reinforcing yarns of the layers are symmetrically arranged in respect of the zero-degree direction of the non-crimp fabric and, with respect to the direction of their extension, form an angle $\alpha$ to the zero-degree direction, said angle not being equal to 90° or 0°, and wherein the multiaxial non-crimp fabric is characterized in that the sewing threads have a linear density in the range from 10 to 35 dtex.

It has been shown that in particular the stability is significantly improved with respect to compression loading if the linear density of the sewing threads in the multiaxial non-crimp fabric lies in the range required according to the invention. Fine sewing threads of this type have not been used in multiaxial non-crimp fabrics up until now. Surprisingly it has been shown that, by using sewing threads in the multiaxial non-crimp fabrics that have the linear density required according to the invention, a significant increase of stability of the composites produced therefrom is achieved. This is ascribed to the fact that the fiber structure of the individual fiber layers is significantly homogenized compared to known multiaxial non-crimp fabrics. In particular it has been observed that the filaments of the reinforcing yarns show a straighter course than is the case for non-crimp fabrics of the prior art. The sewing threads preferably have a linear density in the range from 10 to 30 dtex and particularly preferably a linear density in the range from 15 to 25 dtex. The use of yarns having a low linear density at best as knitting threads for the production of e.g. knits for textile applications such as for the production of bi-elastic fusible interlinings for outer garments such as sports jackets is known. Fusible interlinings of this type are described e.g. in DE 93 06 255 U1, in which, however, the knitting threads wind around the warp and weft threads of the underlying fabric. This is also applicable to the fabric of WO 2006/055785 for motor vehicle restraint systems (air bags), in which a layer of yarns lying in the warp direction and a layer of yarns lying in the weft direction are connected to each other by means of knitting threads having a low linear density.

The individual layers constructed from multifilament reinforcing yarns of the non-crimp fabric according to the invention can be produced by means of standard methods and apparatuses and placed superimposed at defined angles with respect to the zero-degree direction. Known machines in this field are the LIBA machines or the Karl Mayer machines. By this means, the reinforcing yarns as well can be positioned within the layers with respect to each other such that they abut each other, i.e. they lie adjacent essentially without gaps.

It is, however, also possible that the layers of the multiaxial non-crimp fabric according to the invention comprise prefabricated unidirectional woven fabrics made from multifilament reinforcing yarns. For these unidirectional fabrics, the reinforcing yarns arranged parallel to each other and forming the respective layer are connected to each other by chains made of loose binding threads, which extend essentially transverse to the reinforcing yarns. Unidirectional fabrics of this type are described for example in EP 0 193 479 B1 or EP 0 672 776, to which explicit reference is made here regarding this disclosure.

As reinforcing fibers or reinforcing yarns, fibers or yarns are considered that are usually used in the field of fiber composite technology. Preferably, for the multifilament reinforcing yarns used in the multiaxial non-crimp fabric according to the invention, these are carbon fiber, glass fiber, or aramid yarns, or high-grade UHMW polyethylene yarns. Particularly preferably these are carbon fiber yarns.

The non-crimp fabrics according to the invention are symmetrical with respect to their layer structure. This means that the number of layers in the multiaxial non-crimp fabrics according to the invention in which the reinforcing yarns form a positive angle $\alpha$ to the zero-degree direction, and the number of layers in which the reinforcing yarns form a complementary negative angle $\alpha$ to the zero-degree direction, is the same. Thus, the multiaxial non-crimp fabric according to the invention can for example have a structure with one +45°, one −45°, one +45°, and one −45° layer. Usually, the angles $\alpha$ for multiaxial non-crimp fabrics are found in the range from ±20° to approximately ±80°. Typical angles a are ±25°, ±30°, ±45°, and ±60°. In a preferred embodiment of the non-crimp fabric according to the invention, the absolute value of the angle $\alpha$ to the zero-degree direction lies in the range from 15° to 75°.

In order to also accommodate e.g. further directions of stress in the later component, the multiaxial non-crimp fabric according to the invention comprises preferably also layers of multifilament reinforcing yarns in which the reinforcing yarns form an angle of 0° with respect to the zero-degree direction and/or layers in which the reinforcing yarns form an angle of 90° with respect to the zero-degree direction. These 0° and/or 90° layers are located preferably between the layers oriented at the angle $\alpha$. However, for example, a structure having the following directions is also possible: 90°, +30°, −30°, 0°, −30°, +30°, 90°, i.e. a structure in which the outer layers are formed of 90° layers.

With respect of the tenacity with regard to compression loadings and/or impact loadings of composite components produced by using the multiaxial non-crimp fabrics according to the invention, it was surprisingly determined that an especially good level of tenacity is achieved if the stitch length s of the sewing threads is dependent on the stitch width w and also on the angle $\alpha$ of the reinforcing yarns in the multiaxial non-crimp fabric according to the invention, satisfying the following relations (1) and (II):

$$2\text{ mm} \le s \le 4\text{ mm} \quad \text{(I)}$$

and $$s = n \cdot B \cdot \frac{w \cdot |\tan\alpha_1|}{2.3}, \quad \text{(II)}$$

where the multiplier B can assume values in the range of $0.9 \le B \le 1.1$ and n can assume the values 0.5, 1, 1.5, 2, 3, or 4, whereby also for small values of $w \cdot |\tan \alpha_1|/2.3$, the stitch length s lies in the range required according to equation (I). The stitch width w, i.e. the distance between the sewing threads is thereby indicated in mm.

The angle $\alpha_1$ is understood to be the angle to the zero-degree direction, when viewed from above, at which the reinforcing yarns of the first layer of the multiaxial non-crimp fabric are arranged whose reinforcing yarns have an angle differing from 90° and 0° to the zero-degree direction. In the case that the reinforcing yarns of the top-most layer or the top-most layers of the multiaxial non-crimp fabric have an angle of 90° or 0° to the zero-degree direction, then the first layer arranged below this layer or below these layers is considered whose reinforcing yarns have an angle differing from 90° and 0°.

Upon examination of the fiber structure, i.e. the course of the fibers or the filaments of the multifilament reinforcing yarns in the layers of the multiaxial non-crimp fabric, it was found that by complying with the relations (I) and (II) a very even course of the fibers resulted, with a significantly reduced waviness of the yarns and a significantly reduced appearance of gaps between yarn bundles. For this purpose it is obviously critical that, along the course of a yarn bundle or fiber strand, the sewing threads pierce the fiber strand at different positions over the width of the fiber strand. For values usually set with respect to stitch length and stitch width outside of the ranges defined by the relations (I) and (II), it has been observed that the penetration of the sewing threads along the extension of the reinforcing yarns occurs essentially between the same fibers or filaments or the same regions of the fiber strand or the reinforcing yarn. This leads thereby to pronounced waviness in the course of the yarn and to the formation of gaps between filaments.

Altogether it was found that when using the sewing threads according to the invention with low linear density and when complying with the above-cited relations (I) and (II) in the view from above of the layers of the reinforcing yarns, the fiber deflection caused by the penetration points of the sewing threads in the non-crimp fabric, also referred to as the undulation angle, can be reduced by up to approximately 25%. At the same time, the resulting undulation areas, i.e. the areas or regions in which the filaments or threads show a deflection, can be reduced by approximately 40% and the free spaces between fibers, resulting in regions with increased proportion of resin and reduced tenacity in the component, are thus significantly reduced.

At the same time, by reference to micrographs of composite laminates based on the multiaxial non-crimp fabrics according to the invention, it was found that by using the preferred sewing threads according to the invention with low linear density, surprisingly a significant homogenization of the course of the reinforcing threads was achieved in the direction of observation parallel to the extension of the layers of the reinforcing yarns and perpendicular to the reinforcing yarns. Thus, by using a sewing thread with a linear density of 23 dtex, an essentially linear course of the filaments of the reinforcing yarns was achieved. By using a sewing thread with a linear density outside of the range required according to the invention, already at a linear density of 48 dtex, when viewed across the stated cross section of the composite laminate, all filaments showed a very irregular, wave-shaped course with variation amplitudes on the order of the thickness of one layer of reinforcing threads.

Here, the stitch length can lie in the range from 2 mm to 4 mm. At stitch lengths above 4 mm, a sufficient stability of the multiaxial non-crimp fabric according to the invention can no longer be guaranteed. Below 2 mm, in contrast, an excessively high number of imperfections appear in the non-crimp fabric. In addition, the economy of the production of the multiaxial non-crimp fabrics is greatly reduced.

The yarns usually used to produce yarn non-crimp fabrics can be considered for use as sewing threads, as long as they have the linear density required according to the invention. Preferably the sewing threads are multifilament yarns. Preferably, the sewing threads consist of polyamide, polyaramid, polyester, polyacrylic, polyhydroxy ether, or copolymers of these polymers. The sewing threads consist particularly preferably of multifilament yarns made from polyester, polyamide, or polyhydroxy ether, or copolymers of these polymers. In the process, sewing yarns can be used that, during the later resin injection, e.g. melt above the resin injection temperature, but below the curing temperature of the resin used. The yarns can also melt at the curing temperature. The sewing yarns can also be of the type that can dissolve in the matrix resin, e.g. during the injection or also during the curing of the resin. Sewing threads of this type are described e.g. in DE 199 25 588, EP 1 057 605, or U.S. Pat. No. 6,890,476, to which explicit reference is made regarding this disclosure.

It is advantageous if the sewing threads have an elongation at break of ≥50% at room temperature. Due to the high elongation at break, an improved drapability of the multiaxial non-crimp fabric according to the invention is achieved, by which means more complex structures or components can be realized. Within the context of the present invention, sewing threads are also understood as threads that are not incorporated via sewing in the multiaxial non-crimp fabric according to the invention, but instead via other stitch or loop forming textile processes, such as in particular via knitting processes. The stitches, via which the sewing threads connect the layers of the multiaxial non-crimp fabric to each other, can have the types of weaves that are usual for multiaxial non-crimp fabrics, such as tricot knit or fringe weave. A fringe weave is preferred.

In a preferred embodiment of the multiaxial non-crimp fabric according to the invention, a non-woven is arranged on top of and/or between the at least two layers of reinforcing yarns, i.e. the reinforcing yarn layers, and said non-woven is connected to the layers of reinforcing yarns by the sewing threads. A textile fabric made from non-directional, short-cut fibers or staple fibers can be used for the non-woven, or a random laid layer made from continuous filaments, which layer must be bonded, e.g. through application of temperature and through pressure, whereby the filaments melt at the contact points and thus form the non-woven. An advantage of using a non-woven between the reinforcing layers lies among other things in a better drapability and or a better ability of the multiaxial non-crimp fabric to be infiltrated with matrix resin. For this process, the non-woven can, for example, be a glass non-woven or a non-woven made from carbon fibers.

Preferably the non-woven is made from a thermoplastic polymer material. Non-wovens of this type are, as has already been explained, disclosed for example in DE 35 35 272 C2, EP 0 323 571 A1, US 2007/0202762 A1, or US 2008/0289743 A1. With regard to a suitable selection of thermoplastic polymer materials, the non-woven can function as an agent for increasing the impact strength, and additional means for increasing impact strength then do not need to be added to the matrix material itself any longer. The non-woven should still have a sufficient stability during the infiltration of the multiaxial non-crimp fabric with matrix material, but it should melt at subsequent pressing and/or curing temperatures. Preferably, therefore, the thermoplastic polymer material forming the non-woven has a melting temperature that lies in the range from 80 to 250° C. For applications in which epoxy resins are introduced as matrix materials, non-wovens made from polyamide have proven themselves.

Thereby it is advantageous if the non-woven comprises two thermoplastic polymer components that have differing melting temperatures, i.e. a first polymer component with a lower melting temperature and a second polymer component with a higher melting temperature. Thereby, the non-woven can consist of a mixture of mono-component fibers with differing melting temperatures, thus being a hybrid non-woven. However, the non-woven can also consist of bi-component fibers, for example, of core-sheath fibers, whereby the core of the fiber is made from a higher-melting polymer and the sheath is made of a lower-melting polymer. During the processing of the multiaxial non-crimp fabrics according to the invention with hybrid non-wovens or bi-component non-wovens of this type into preforms, i.e. during the shaping of the multiaxial non-crimp fabrics, with a suitable application of heat during the shaping at temperatures above the melting point of the lower-melting non-woven component, but below the melting point of the higher-melting non-woven component, a good shapeability can be achieved, and after cooling, a good stabilization and fixation of the shaped non-crimp fabric. Similarly to a non-woven made from bi-component fibers, the non-woven can also be made e.g. from a random laid layer of fibers made from the second polymer component, wherein the first polymer component is applied to the fibers of the second polymer component e.g. by spraying or coating. The coating can for example result from an impregnation with a dispersion or solution of the first polymer component, wherein after the impregnation, the liquid portion of the dispersion, or the solvent, is removed. It is likewise possible that a non-woven constructed from fibers made from the second polymer component contains the first polymer component in the form of fine particles embedded between the fibers of the second polymer component.

In a preferred embodiment of the multiaxial non-crimp fabric according to the invention, the first polymer component, with a higher melting temperature, forming the non-woven has a melting temperature in the range between 140° and 250° C. It is likewise preferred if the second polymer component with a lower melting temperature has a melting temperature in the range between 80° and 135° C.

In a further preferred embodiment, the non-woven is made from a polymer material that is at least partially soluble in the matrix material. Particularly preferred is that the polymer material is soluble in epoxy resins, cyanate ester resins, or benzoxazine resins. Non-wovens of these types are described for example in US 2006/0252334 or EP 1 705 269. More particularly preferred is a non-woven made from polyhydroxy ether because it dissolves in the matrix resin and crosslinks with the matrix resin during the curing process thereof to form a homogeneous matrix.

In a likewise preferred embodiment, the non-woven is constructed from a first thermoplastic polymer component with a higher melting temperature and a second thermoplastic polymer component with a lower melting temperature, and the second polymer component is at least partially soluble in the matrix material. Particularly preferably the lower-melting second polymer component is soluble in epoxy resins. Preferably this non-woven is a hybrid non-woven, i.e. a non-woven made from a mixture of mono-component fibers with differing melting temperatures. Preferably thereby the first polymer component with a higher melting temperature has a melting temperature in the range between 140° and 250° C. At such temperatures, the part of the non-woven that consists of the first polymer component melts only above the temperatures which as a rule prevail during the injection of the matrix resin. Because the first polymer component thus does not yet melt at the resin injection temperature, a good dimensional consistency of the multiaxial non-crimp fabric is guaranteed in this phase.

Particularly preferably the first polymer component is made from a polyamide homopolymer or a polyamide copolymer or a mixture of polyamide homopolymers and/or polyamide copolymers. In particular, the polyamide homopolymer or polyamide copolymer is a polyamide 6, polyamide 6,6, polyamide 6,12, polyamide 4,6, polyamide 11, polyamide 12, or a copolymer based on polyamide 6/12.

It is likewise preferred if the second polymer component in this non-woven has a melting temperature in the range between 80° and 135° C. At the same time, however, as explained, it should be soluble in the matrix material. Therefore the second polymer component is particularly preferably a polyhydroxy ether that completely dissolves in the resin system, especially in epoxy resins, cyanate ester resins, or benzoxazine resins already during the infiltration of the multiaxial non-crimp fabric according to the invention with these matrix resins, i.e., for example during the resin infusion process, and then forms the matrix resin system together with the matrix resin. In contrast, the first polymer component does not dissolve in the matrix system and remains during and after the resin infusion process and also after the curing of the matrix system, comprising its own phase.

Thereby, in respect of the characteristics of the composite components produced using the multiaxial non-crimp fabrics according to the invention, especially in respect of the impact strength thereof and the matrix content thereof, it is advantageous if the non-woven contains the first polymer component in a proportion of 20 to 40 wt. % and the second polymer component in a proportion of 60 to 80 wt. %. In all it is preferable if the non-woven present in the multiaxial non-crimp fabric according to the invention has a mass per unit area in the range from 5 to 25 g/m$^2$ and particularly preferably a mass per unit area in the range from 6 to 20 g/m$^2$.

The multiaxial non-crimp fabrics according to the invention are distinguished by a good drapability and by a good resin permeability. In addition, they enable the production of components with high stability against compression loading and high tolerance to impact loading. They are therefore especially suitable for the production of so-called preforms, from which more complex fiber composite components are produced. Therefore the present invention relates especially also to preforms for the production of fiber composite components which contain the multiaxial non-crimp fabrics according to the invention.

Figure 2:
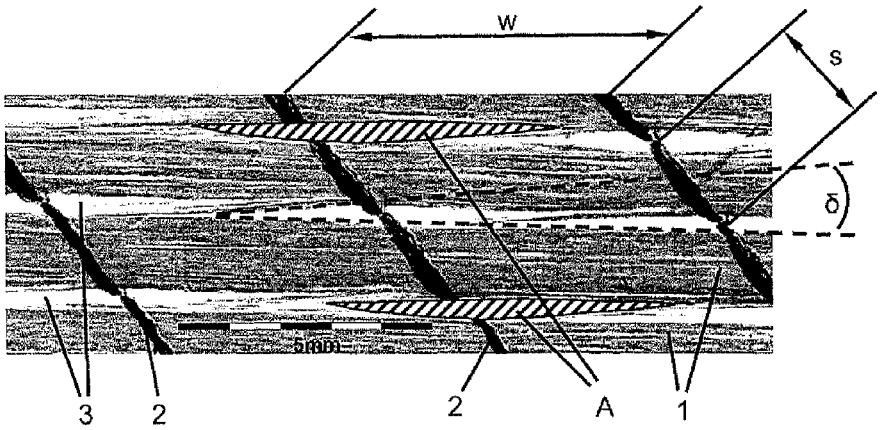
FIG. 2 is a schematic representation of the segment of a stitched multiaxial non-crimp fabric shown in FIG. 1 viewed from above (negative presentation).

The invention will be explained in more detail on the basis of the figures and examples, wherein the scope of the invention is not limited by the examples. FIG. 1 and FIG. 2 show a photo of a segment of a multiaxial non-crimp fabric viewed from above, in which the uppermost layer of the non-crimp fabric is visible. Hereby, FIG. 2 presents the segment shown in FIG. 1 as a negative for better representation, i.e., areas that appear white in FIG. 1 appear black in FIG. 2 and black areas in FIG. 1 appear white in FIG. 2. From the uppermost layer, carbon fiber filament yarns 1 can be recognized running in the figures from left to right, arranged parallel next to each other and abutting each other, which yarns 1 are connected by sewing threads 2 to each other and to the layer lying thereunder, which cannot be seen in the figures. The segment of the multiaxial non-crimp fabric represented in FIGS. 1 and 2 is turned at 45° in the plane, such that the sewing threads do not run in the 0° direction, but rather at an angle of 45°. By this means, the carbon fiber yarns arranged at an angle $\alpha_1$ of 45° in relation to the sewing threads run from left to right in FIGS. 1 and 2. Due to the stitch formation (fringe weave), the sewing threads 2 penetrate the carbon fiber filament yarns 1 at a defined distance which corresponds to the stitch length s, wherein the sewing threads 2 have a distance w from each other, designated as the stitch width.

As a result of the penetration of the sewing threads 2 through the respective layer of the multiaxial non-crimp fabric, gaps 3 arise between the filaments of the carbon fiber yarns 1, and fiber deflections occur, from which an opening angle δ can be determined. Due to the fiber deflections between the filaments of the carbon fiber yarns, open spaces arise between the filaments, whose two-dimensional extension in the plane of observation within the context of the present invention is designated as the undulation area A. In these open spaces there will be in the subsequent component an increased proportion of resin and a decreased tenacity of the component.

EXAMPLES 1 AND 2

A multiaxial non-crimp fabric based on carbon fibers was produced on a multiaxial system (type "Cut&Lay" Carbon, Karl Mayer Textilmaschinenfabrik GmbH). For this purpose, initially individual layers with a mass per unit area of 134 g/m$^2$ were produced from carbon fiber yarns (Tenax®-E IMS65 E23 24k 830tex; Toho Tenax Europe GmbH) laid parallel next to each other and in contact with each other. Two of these individual layers were superimposed such that the lower layer in relation to the production direction of the multiaxial non-crimp fabric had an angle α of +45° and the upper layer had an angle α of −45°. The superimposed individual layers were knitted to each other by means of sewing threads in a fringe weave. The sewing threads used in Example 1 consisted of a co-polyamide and had a linear density of 23 dtex. In Example 2, sewing threads were used made from polyester with a linear density of 35 dtex. The stitch length s was 2.6 mm, and the stitch width w was 5 mm.

To assess the quality of the non-crimp fabric produced in this manner, photos of the surface of the non-crimp fabric were produced by means of a calibrated reflected-light scanner with a resolution of 720 dpi, and evaluated by means of optical image evaluation using the Software Analysis AutoS (Olympus). The evaluation was done with respect to the fiber deflections caused by the penetration of the sewing threads, characterized by the opening angle δ, and with respect to the undulation areas A resulting therefrom corresponding to the schematic presentation shown in FIG. 2. The results obtained are listed in Table 1.

COMPARATIVE EXAMPLES 1 AND 2

The proceedure of Example 1 was repeated. In Comparative Example 1, however, polyester sewing yarns with a linear density of 48 dtex were used and in Comparison example 2 polyester sewing yarns with a linear density of 75 dtex were used. The results with respect to the fiber deflections caused by the penetration of the sewing threads, characterized by the opening angle δ, and with respect to the undulation areas A resulting therefrom are likewise specified in Table 1.

TABLE 1

| Non-crimp fabric from | Linear density of the sewing yarn [dtex] | Stitch length [mm] | Fiber deflection opening angle δ [°] | Undulation area A [mm$^2$] |
|---|---|---|---|---|
| Example 1 | 23 | 2.6 | 5.30 | 1.10 |
| Example 2 | 35 | 2.6 | 6.01 | 1.40 |
| Comp. example 1 | 48 | 2.6 | 6.09 | 1.68 |
| Comp. example 2 | 76 | 2.6 | 6.34 | 1.94 |

EXAMPLES 3 AND 4

In order to determine the influence of different sewing yarn linear densities on the mechanical characteristics of a laminate, non-crimp fabrics (type 1) were produced as in Example 1 made from two individual layers, oriented at +45° and -45°, made from carbon fiber yarns (Tenax®-E 1MS65 E23 24k 830 tex; Toho Tenax Europe GmbH) laid parallel next to each other and abutting each other, the layers having a mass per unit area of 134 g/m$^2$. In the same way, non-crimp fabrics were produced whose individual layers were oriented in −45° and +45° (type 2). The individual layers of the non-crimp fabrics of type 1 and type 2 were each stitched (knitted) to each other by means of sewing threads with a linear density of 23 dtex (Example 3) or 35 dtex (Example 4) as indicated in Example 1.

A layer of a non-crimp fabric with +45°/−45° orientation (type 1) was combined with a layer of a non-crimp fabric symmetrical thereto with −45°/+45° (type 2) by superimposing into a stack of four individual layers to produce a laminate. This process was repeated and in this way a stack of a total of eight of these four superimposed individual layers was built such that the entire stack comprised a total of 32 layers. By means of this procedure, a stack was produced whose layers were knitted to each other by means of 23 dtex sewing thread (Example 3) and a stack whose layers were knitted to each other by means of 35 dtex sewing thread (Example 4).

The stacks thus produced were further processed via a resin infusion method into laminates. The epoxy system HexFlow RTM6 from Hexcel, which cures at 180° C., was used as the resin system. A laminate was produced with a total thickness after infusion and curing of 4.0 mm and a fiber volume content of 60 vol. %.

The laminate was rotated by 45° such that the carbon fibers were oriented in 0° and 90°. Test specimens according to DIN EN 6036-11 were produced from the laminate thus presented, the edges of said test specimens extending in the direction of the carbon fibers in the laminate, i.e. the fiber orientation in the test specimens was 90°/0°. The compression strength for the test specimen thus produced was determined using a testing machine, Zwick Z 250, according to DIN EN 6036. The results are summarized in Table 2.

Figure 3:
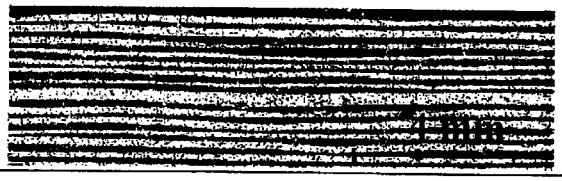
FIG. 3 is a chart showing the results of Examples 3 and 4 and Comparative Example 3.
Figure 3:
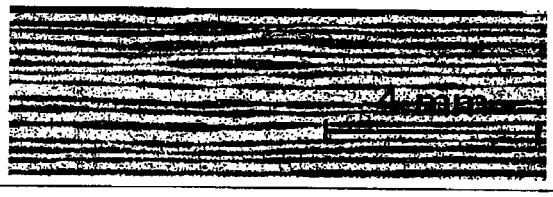
Figure 3:
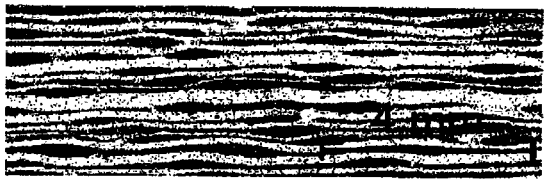

In addition, micrographs of cross sections perpendicular to the surface extension of the individual layers and parallel to the 0° orientation of the carbon fibers were produced for the laminates. The micrographs are summarized in FIG. 3. It shows that, when using sewing threads with 23 dtex and with 35 dtex, there was a good straightness of the carbon fibers in the 0° orientation (recognizable in the micrographs as light-colored lines), i.e. the carbon fibers show no or only a small deviation from a straight line.

COMPARATIVE EXAMPLE 3

The proceedure of Example 3 was repeated. However, to produce the non-crimp fabrics having +45°/45° orientation (type 1) and non-crimp fabrics symmetrical thereto having −45°/+45° orientation (type 2), sewing threads with a linear density of 48 dtex were used in Comparative Example 3. The results are listed in Table 2.

TABLE 2

| Laminate from: | Linear density of the sewing yarn [dtex] | Fiber mass per unit area per individual layer [g/m$^2$] | Compression strength [MPa] (normalized to 60% fiber volume proportion) |
|---|---|---|---|
| Example 3 | 23 | 134 | 641.8 |
| Example 4 | 35 | 134 | 598.1 |
| Comp. example 3 | 48 | 134 | 372.6 |

For the laminate of Comparative Example 3, a micrograph of a cross section perpendicular to the surface extension of the individual layers and parallel to the 0° orientation of the carbon fibers was produced, too. The micrograph of Comparative Example 3 is likewise found in FIG. 3. The use of sewing threads with 48 dtex for the laminate of Comparative Example 3 resulted in a comparatively turbulent image: the carbon fibers in the 0° orientation (recognizable in the micrograph as light-colored lines) show a distinct wavy course, i.e. in part clear deviations from a straight-line course. Due to the thicker sewing threads, there is undulation of the carbon fibers perpendicular to the extension of the individual layers. Deviations of this type from a straight-line course of the carbon fibers could be the cause of a decreased compression strength.

EXAMPLES 5 TO 7

The proceedures of Example 1 and Example 3 were repeated, wherein sewing threads with a linear density of 23 dtex were used. While maintaining a stitch width w of 5 mm, the stitch length was varied, and the stitch lengths s were set at 3.1 mm (Example 5), 2.5 mm (Example 6), and 2.2 mm (Example 7).

It was found that the values obtained for the compression strength lay at an overall high level due to the use of the low linear density sewing thread with a linear density of 23 dtex. However, the laminate from Example 6, for which a stitch width for the production of the non-crimp fabrics was set at 2.5 mm, had the lowest compression strength. Here it is noted that the stitch width of 5 mm corresponds exactly to double the stitch length of 2.5 mm, and thus the stitch width is an integer multiple of the stitch length. This results in that, at an orientation of the carbon fibers at an angle of +45° or −45°, there is a high risk that the penetration of the sewing threads in one and the same carbon fiber yarn occurs along its length at the same place over its width. As a result, there can occur a splitting of the carbon fiber yarn along its entire length, which leads to a reduction of the distribution of forces under compression stress in the direction of the fiber orientation.

TABLE 3

| Non-crimp fabric/ laminate from: | Linear density of the sewing yarn [dtex] | Stitch length [mm] | Fiber mass per unit area per individual layer [g/m$^2$] | Compression strength [MPa] (normalized to 60% fiber volume proportion) |
|---|---|---|---|---|
| Example 5 | 23 | 3.1 | 134 | 668.5 |
| Example 6 | 23 | 2.5 | 134 | 610.8 |
| Example 7 | 23 | 2.2 | 134 | 676.6 |

The invention claimed is:

1. A multiaxial non-crimp fabric made from at least two superimposed layers of multifilament reinforcing yarns which are arranged within the layers parallel to each other and abutting parallel together, wherein the reinforcing yarns within one layer as well as adjacent layers are connected to each other and secured against each other by sewing threads forming stitches proceeding parallel to each other and separated from each other at a stitch width w, wherein the sewing threads form stitches with a stitch length s;

the zero-degree direction of the non-crimp fabric is defined by the sewing threads;

the reinforcing yarns of the layers are symmetrically arranged with respect to the zero-degree direction of the non-crimp fabric and, with respect to the direction of their extension, form an angle $\alpha$ to the zero-degree direction, the angle not being equal to 90° or 0°; and the sewing threads have a linear density in the range of from 10 to 35 dtex.

2. The multiaxial non-crimp fabric according to claim 1, wherein the absolute value of the angle $\alpha$ to the zero-degree direction is in the range of from 15° to 75°.

3. The multiaxial non-crimp fabric according to claim 1, wherein the non-crimp fabric further comprises layers of multifilament reinforcing yarns in which the reinforcing yarns form an angle of 0° with respect to the zero-degree direction and/or layers in which the reinforcing yarns form an angle of 90° with respect to the zero-degree direction.

4. The multiaxial non-crimp fabric according to claim 1, wherein the stitch length s of the sewing threads depends on the stitch width as well as on the angle $\alpha_1$ of the reinforcing yarns and satisfies relations (I) and (II):

$$2\ \text{mm} \leq s \leq 4\ \text{mm} \quad \text{(I)}$$

$$s = n \cdot B \cdot \frac{w \cdot |\tan\alpha_1|}{2.3} \quad \text{(II)}$$

where w=stitch width [min], 0.9≤B≤1.1, n=0.5, 1, 1.5, 2, 3, or 4, and angle $\alpha_1$ is understood as the angle $\alpha$ to the zero-degree direction, when viewed from above, at which reinforcing yarns of a first layer of the multiaxial non-crimp fabric are arranged and have an angle differing from 90° and 0° to the zero-degree direction.

5. The multiaxial non-crimp fabric according to claim 1, wherein the sewing threads have a elongation at break of ≥50% at room temperature.

6. The multiaxial non-crimp fabric according to claim 1, wherein the sewing threads have a linear density in the range from 10 to 30 dtex.

7. The multiaxial non-crimp fabric according to claim 1, wherein the sewing threads are multifilament yarns made from polyester, polyamide, polyhydroxy ether, or copolymers of these polymers.

8. The multiaxial non-crimp fabric according to claim 1, wherein the multifilament reinforcing yarns are carbon fiber, glass fiber, aramid yarns, or high-grade UHMW polyethylene yarns.

9. The multiaxial non-crimp fabric according to claim 1, wherein a non-woven is arranged on and/or between the at least two superimposed layers.

10. The multiaxial non-crimp fabric according to claim 9, wherein the non-woven has a mass per unit area in the range from 5 to 25 g/m$^2$.

11. The multiaxial non-crimp fabric according to claim 9, wherein the non-woven comprises multiple thermoplastic polymer components with differing melting temperatures.

12. The multiaxial non-crimp fabric according to claim 11, wherein a polymer component with a lower melting temperature has a melting temperature in the range between 80° and 135° C.

13. The multiaxial non-crimp fabric according to claim 11, wherein a polymer component with a higher melting temperature has a melting temperature in the range between 140° and 250° C.

14. A preform for producing composite components, wherein the preform comprises the multiaxial non-crimp fabric according to claim 1.

* * * * *